United States Patent [19]

Kopp et al.

[11] 4,269,016

[45] May 26, 1981

[54] PLURAL LINEBAG FORMING AND FILLING APPARATUS

[75] Inventors: Josef Kopp, Griesheim; Ernst Hüther, Darmstadt; Ernst Bohländer, Ueberau, all of Fed. Rep. of Germany

[73] Assignee: Zupack-Gesellschaft mbH, Darmstadt, Fed. Rep. of Germany

[21] Appl. No.: 966,131

[22] Filed: Dec. 1, 1978

[51] Int. Cl.[3] ..... B65B 9/08

[52] U.S. Cl. ..... 53/546; 53/547; 53/563; 53/202; 493/252

[58] Field of Search ..... 53/546, 547, 202, 551, 53/450, 456, 563, 469; 93/10, 12 R, 12 C

[56] References Cited

U.S. PATENT DOCUMENTS

| | | | |
|---|---|---|---|
| 3,373,663 | 3/1968 | Heim | 93/12 R X |
| 3,948,019 | 4/1976 | Döring et al. | 53/202 |
| 3,983,682 | 10/1976 | Scully | 53/547 X |
| 4,117,649 | 10/1978 | Egli | 93/12 R |

FOREIGN PATENT DOCUMENTS

| | | | |
|---|---|---|---|
| 2645810 | 4/1978 | Fed. Rep. of Germany | 53/202 |

*Primary Examiner*—Horace M. Culver
*Attorney, Agent, or Firm*—Michael J. Striker

[57] ABSTRACT

A packaging method and apparatus are disclosed. Two separate streams of bags are formed. The successive bags of each stream are alternately deposited on two side-by-side tracks of a conveyor, thus obtaining four partial streams of bags which are then successively conveyed to filling, sealing and discharge stations.

4 Claims, 6 Drawing Figures

PLURAL LINE BAG FORMING AND FILLING APPARATUS

BACKGROUND OF THE INVENTION

1. Field of the Invention

This invention relates to the packaging art.

More particularly, the present invention relates to a method of packaging goods, and to an apparatus for carrying out the method.

2. The Prior Art

Packaging apparatus is known wherein a tube-forming machine withdraws a web of packaging material (usually synthetic plastic) from a supply roll and converts it into a tube which is then forwarded to a bag-forming station. At that station the tube is severed into individual tube sections and one end of each section is closed to form a bag or pouch. These then travel sequentially to a filling station where they are filled with the goods to be packaged, a sealing station where the filled pouches or bags are sealed, and a delivery station where the finished packages are discharged, e.g. for packing into cartons. The several stations are connected by a conveyor which carries the packages to them.

This type of apparatus is used primarily, but not exclusively, to produce liquid packages containing, for example, milk, fruit juice and the like. It has become widely accepted due to its continuous and automatic operation and the use of packaging material delivered in supply rolls. It appears that the working speed of the entire apparatus is limited essentially only by the maximum possible working speed of the conveyor device along which the filling station, the sealing station and the delivery station are arranged. Thus, if output in excess of the conveyor working speed is required, a second apparatus must be provided. Furthermore, if different packages are to be produced at the same time, for example packages having different volumes and/or differing fillings, separate apparatus must be provided for the production, filling and sealing of each type of different package.

SUMMARY OF THE INVENTION

It is an object of the invention to provide an improved packaging method and apparatus, which avoid the aforementioned prior-art disadvantages.

More particularly, it is an object of the present invention to provide an improved packaging method wherein the maximum output per unit time of the basic machine is not limited by the conveyor working speed to a lower output figure.

Another object of the invention is to provide such an improved method wherein the simultaneous production of different types of packages is possible, e.g. of packages which differ from one another in volume or content.

A concomitant object is to provide an improved packaging apparatus for carrying out the novel method.

Pursuant to these objects, and still others which will become apparent hereinafter, one aspect of the invention resides in a method of packaging goods, which comprises the steps of forming two separate streams of bags, depositing successive bags of each stream alternately on two side-by-side tracks of a conveyor so as to obtain four partial streams, and successively conveying the bags of the partial streams through filling, sealing and discharge stations.

A packaging apparatus embodying the invention may include a pair of packaging machines each including a tube station in which a web of packaging material is withdrawn from a supply roll and shaped into a tube, a bag-forming station in which the tube is subdivided into tube sections which are converted into bags, a filling station in which a product is filled into the bags, a sealing station in which the filled bags are sealed, and a delivery station, all of the stations being arranged sequentially, a conveyor extending along all of the stations and having two side-by-side pairs of conveyor tracks, and means for delivering bags from each of the bag-forming stations alternately to the respective tracks of an associated one of the pairs of tracks.

As mentioned before, the maximum possible output was heretofore limited by the performance of the conveyor along which the filling station, the sealing station and the delivery station are arranged. This bottleneck is now eliminated by the invention, due to the fact that the conveyor has several tracks. Since each tube machine works on two tracks of the conveyor, the output capacity of the tube machine, which is higher than that of a single-track conveyor, is fully exploited. A further doubling of the achievable output results from the fact that two tube machines are now provided, without a substantially higher construction expense being necessary for this purpose in the region of the conveyor. Due to the use of two tube machines it is also possible to produce different packages side by side, for example different package sizes and/or different package contents. For example, in a dairy it is now possible to produce liter packages and half-liter packages of milk and cocoa side by side.

Each tube machine may include an intermediate magazine which is displaceable in timed manner transversely of the conveying direction and which displaces the package wrappers, taken singly from the bag-forming station of the tube machine, alternately to the two sides for transfer to a different track of the conveyor. Involving only low construction expenses, this intermediate magazine permits the alternate and uniform supply of two tracks of the conveyor with package wrappers.

At the position at which the intermediate magazine accepts the package wrappers, and at the two positions at which the wrappers are transferred to the tracks of the conveyor, scraper devices may be provided which take up the package wrappers. Thus, no special ejector devices or the like are necessary at the intermediate magazine. The packages are conveyed into the intermediate magazine as soon as the latter is situated at the acceptance position and out of it as soon as it is situated at one of the two delivery positions.

Each intermediate magazine preferably comprises two commonly transversely displaceable, upwardly and downwardly open reception shafts for the package wrappers. The two intermediate magazines are preferably each driven via a rack by one common pinion. The pinion is preferably drivable by means of a control cam and a cam follower for limited rotating movements.

The conveyor, the two tube machines and the two intermediate magazines may be in driving connection with one another through one common main control shaft. The tube magazines may be constructed so that they can be individually uncoupled according to choice.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

The novel method and apparatus will hereafter be jointly described with reference to the drawings.

Figure 1:
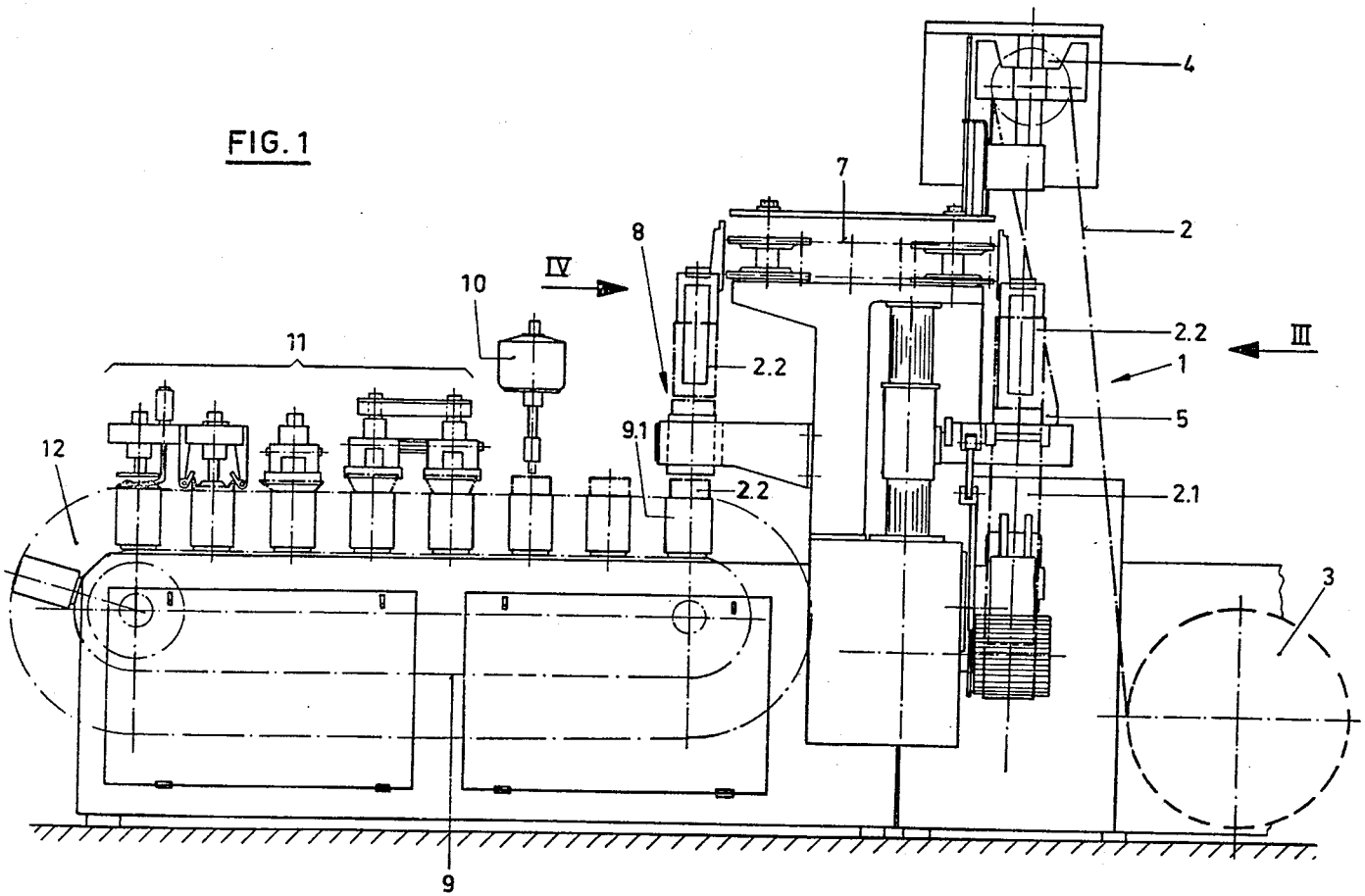
FIG. 1 shows an apparatus for the production, filling and sealing of packages, in a lateral elevational view.
Figure 2:
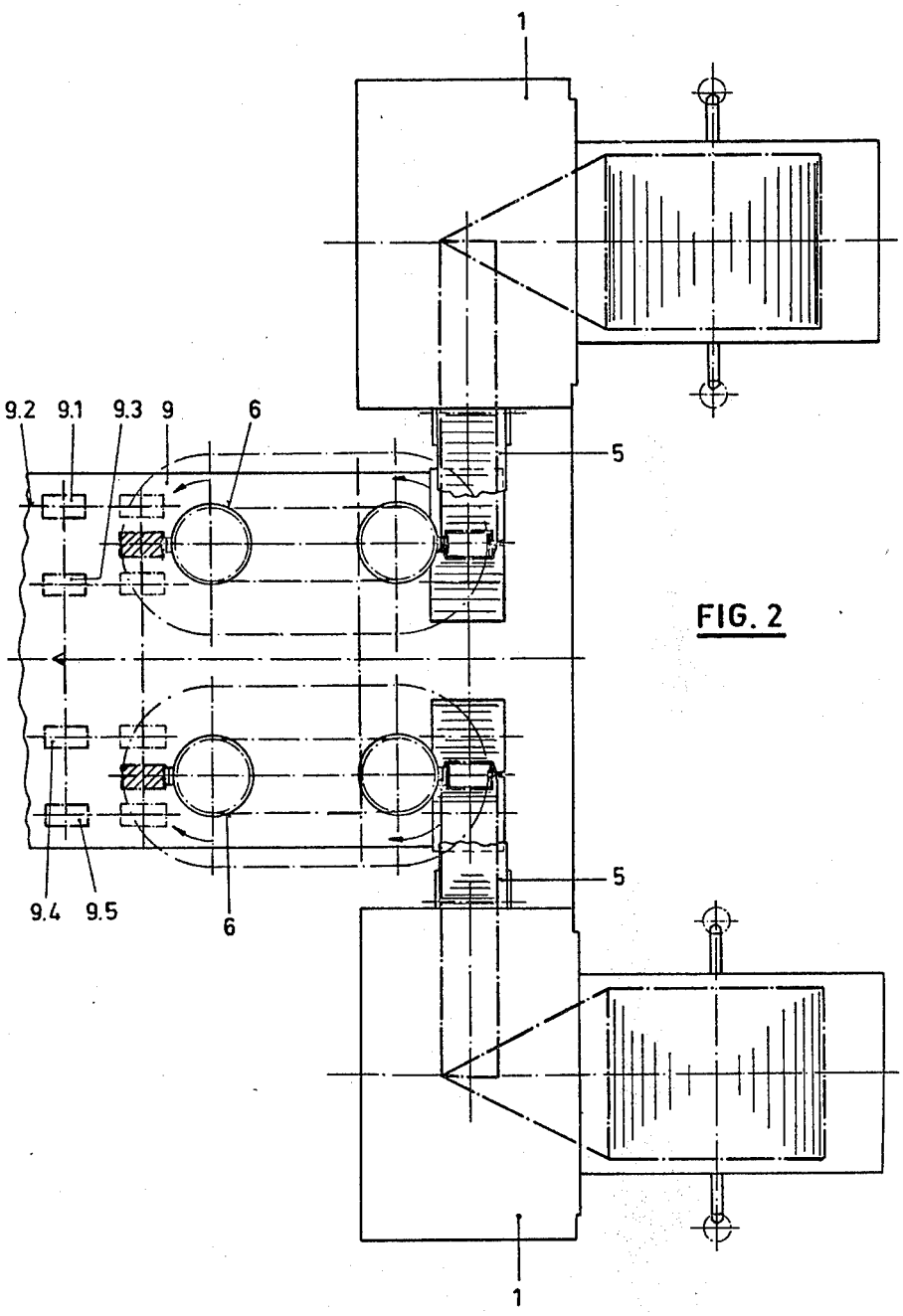
FIG. 2 shows the apparatus in plan view, the part of the apparatus shown on the left in FIG. 1 being omitted for the sake of simplicity.
Figure 3:
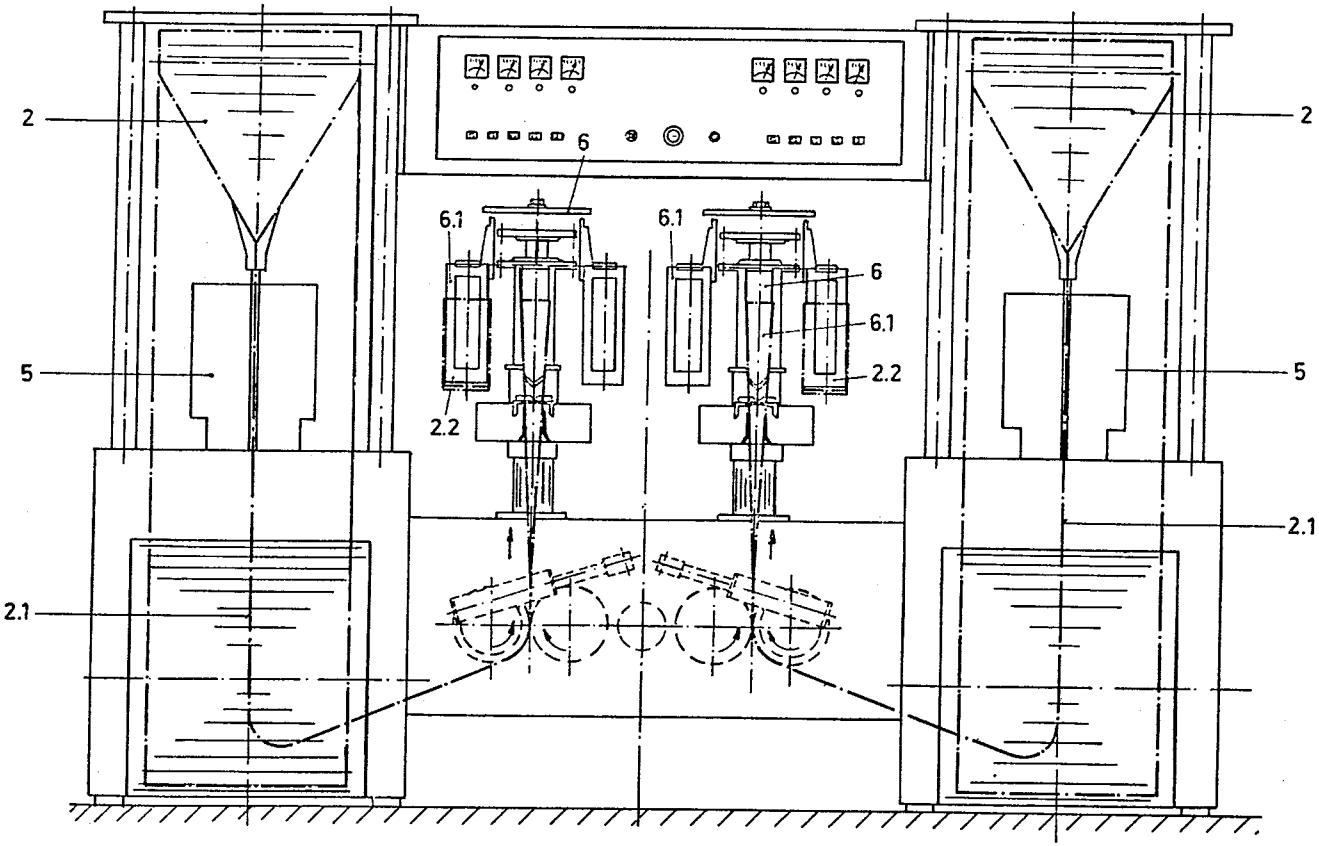
FIG. 3 is a view as seen in the direction of the arrow III in FIG. 1.

The apparatus shown in FIG. 1 for the production, filling and sealing of packages, for example to produce milk and cocoa packages in a dairy, comprises two tube machines 1 which are placed side by side. In each tube machine 1 a packaging material web 2, for example of synthetic plastic-coated paper, is withdrawn from a supply roll 3 and conducted over an upper reversing roller 4. In a tube-forming station 5, which is shown only in simplified form since it is known per se, a tube 2.1 is produced from the web 2 of packaging material by connecting of the two longitudinal edges of the web. The tube 2.1 is then conducted over lower deflector rollers to a bag-forming station 6 where the tube 2.1 is opened out by means of a respective expanding mandrel 6.1 is welded transversely and severed at the lower end of each thus-formed tube section, so that individual bags are produced which are shaped by the expanding mandrel 6.1 into, for example, parallelepipedal package wrappers 2.2.

The shaped package wrappers 2.2 are transported from the expanding mandrels 6.1, which are mounted on a horizontally circulating endless chain 7, to an intermediate magazine 8, one intermediate magazine 8 being provided for each of the two tube machines 1.

The intermediate magazines 8, which are described in greater detail hereinafter, pass the package wrappers 2.2 to a conveyor device in the form of an endless horizontal conveyor 9 which comprises individual small boxes 9.1 each adapted to receive one package wrapper 2.2.

On the endless conveyor 9 there are provided, in side-by-side relationship, four tracks of receiving boxes 9.1, two tracks being allocated to one tube machine 1 and two tracks being allocated to the other tube machine. All the tracks, designated 9.2, 9.3, 9.4 and 9.5, respectively, run in succession in each case beneath a filling station 10 and then a sealing station 11 working in several stages, where the upper package seal is produced. Then the finished packages pass to a delivery station 12, where they are delivered to a further conveyor (not shown) or a packing apparatus for e.g. insertion into boxes.

Figure 4:
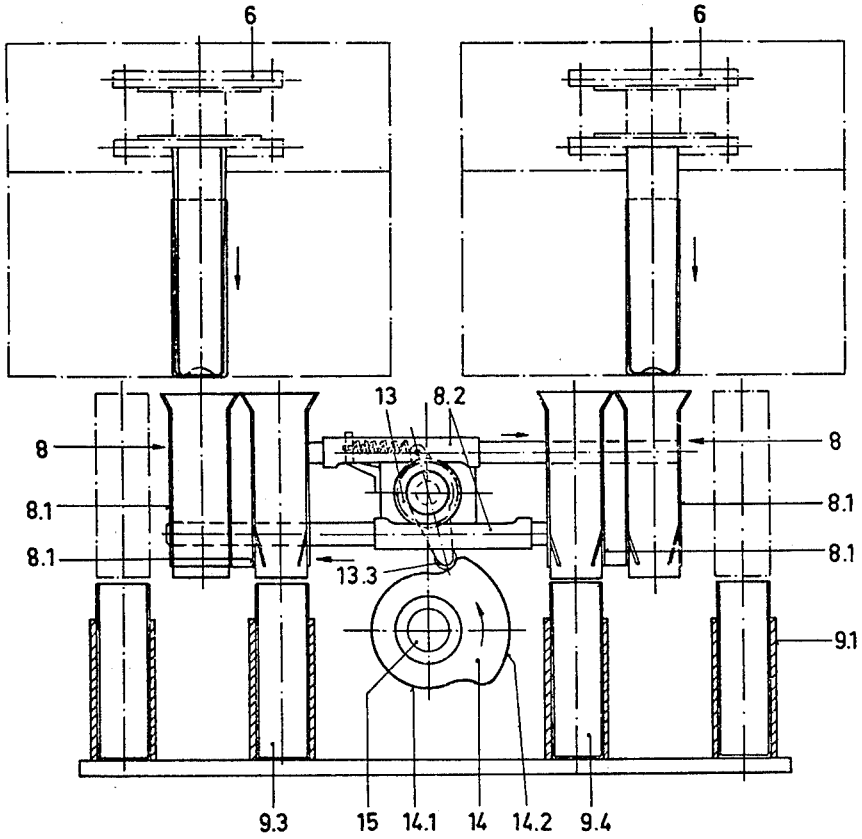
FIG. 4 is an enlarged partial representation of the intermediate magazine, in a view looking in the direction of the arrow IV in FIG. 1.
Figure 5:
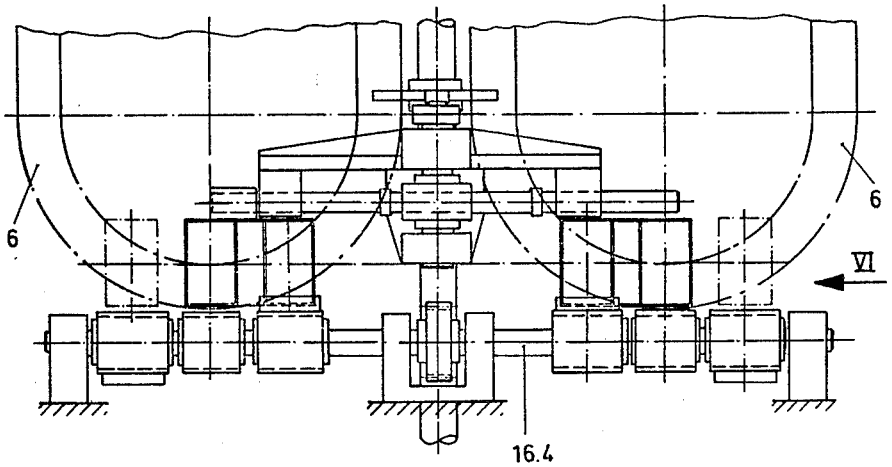
FIG. 5 is a plan view of the part of the apparatus shown in FIG. 4.
Figure 6:
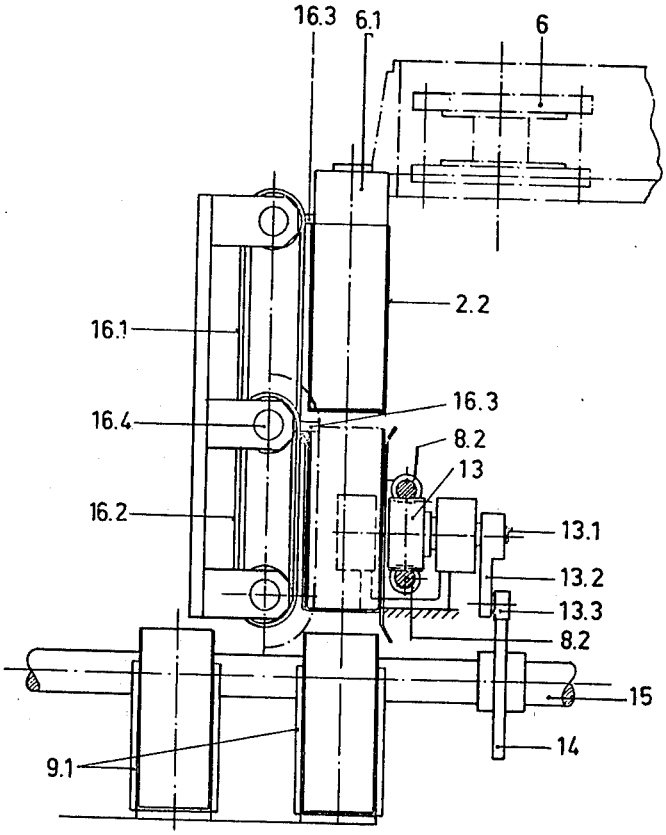
FIG. 6 is a lateral elevational view, looking in the direction of the arrow VI in FIG. 5.

Details of the intermediate magazines 8 and their drive are shown in FIGS. 4, 5 and 6. Each intermediate magazine 8 comprises two upwardly and downwardly open receiving shafts 8.1 for the package wrappers. Each intermediate magazine 8 is connected with a rack 8.2 and displaceable in timed manner transversely of the conveying direction. The two racks 8.2 are driven by a common pinion 13. The pinion 13 is secured on a shaft 13.1 which carries an arm 13.2 on the free end of which a roller 13.3 is mounted which constitutes a cam follower of a control cam 14. The control cam 14 is secured on a main control shaft 15 (only partially shown) extending in the longitudinal direction of the apparatus.

FIG. 4 shows that the control cam 14 has a peripheral section 14.1 with a smaller diameter and a peripheral section 14.2 with a larger diameter. As long as the cam roller 13.3 engages the control cam section 14.1 having the smaller diameter, the intermediate magazines 8 are situated in the position as shown in FIG. 4, i.e. in each case one of the receiving shafts 8.1 of each intermediate magazine 8 is located in the middle position and is ready to receive a package wrapper 2.2., while the other of the two receiving shafts 8.1 is situated above one of the two inner tracks 9.3 and 9.4 of the endless conveyor 9. When the cam roller 13.3 is pivoted by the control cam 14 and tracks the control cam section 14.2, the two intermediate magazines 8 are each shifted outwards in relation to the position shown in FIG. 4, so that a receiving shaft 8.1 is then situated over each of the two outer tracks 9.2 and 9.5.

This positive mechanical drive of the intermediate magazines has proved to be very trouble-proof even under rough working conditions.

Vertically arranged endless conveyor belts 16.1 and 16.2 each have a dog 16.3 and form scraper devices which scrape the package wrappers 2.2 away from the expanding mandrels 6.1 for transfer to the receiving shafts 8.1 and thence into the individual boxes 9.1 of the endless conveyor 9. FIG. 5 shows that the scraper belts 16.1 and 16.2 are driven by a common drive shaft 16.4.

The apparatus disclosed herein permits a very extensive adaptation to different operational requirements. If, for example, an especially large output of a single type of package is desired, the two tube machines 1 deliver the same type of package wrappers which are all filled with the same filling material in the filling station 10. Assuming, arguendo, that the capacity of a single track of the conveyor moving in timed manner beneath the filling station 10 amounts to 2,000 package units per hour, and that the capacity of each tube machine is 4,000 package units per hour, then the apparatus achieves an output of 8,000 package units per hour.

If different packages are to be produced, then the one tube machine may e.g. produce liter packages and the other tube machine half-liter packages. Furthermore, each package size can also be filled with different filling materials, for example the liter packages on one track and the half-liter packages on the other track may be filled with milk, whereas cocoa may be filled into liter packages and half-liter packages on the third and fourth tracks. In this example the apparatus delivers 2,000 liter packages and 2,000 half-liter packages of milk and 2,000 liter packages and 2,000 half-liter packages of cocoa per hour.

A particular advantage of the invention is that an apparatus of the initially described basic type is provided, so that a simple adaptation with relatively slight construction expense allows the apparatus to be converted to operate according to the invention and to deal with different operational requirements, for example as regards different package sizes, different package contents and different output quantities, and to achieve output quantities going far beyond the performance capacity of known machines. Furthermore, by comparison with the use of a plurality of individual apparatuses, the construction expense for the drive and controlling of the individual elements is relatively low and, moreover, reliable synchronism of operation of all individual elements is assured.

While the invention has been illustrated and described as embodied in a packaging apparatus for liquids, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. In a packaging apparatus, a combination comprising a pair of packaging machines arranged side-by-side and each including a tube station in which a web of packaging material is withdrawn from a supply roll and shaped into a tube, a bag-forming station in which the tube is subdivided into tube sections which are converted into bags, a filling station in which a product is filled into the bags, a sealing station in which the filled bags are sealed, and a delivery station, said stations in respective machines being arranged sequentially; a conveyor extending along all of said stations and having two side-by-side pairs of conveyor tracks; means for delivering bags from each of said bag-forming stations alternately to the respective tracks of an associated one of said pairs of tracks, said means comprising two intermediate magazines, one in each of said machines, displaceable in timed movements transversely of the conveyor elongation, each magazine receiving bags individually from the respective bag-forming station and alternately displacing the formed bags towards the respective conveyor track; means for transferring bags at the respective bag-forming station to a respective one of said intermediate magazines; and means for transferring bags from the intermediate magazines to the respective conveyor track.

2. A combination as defined in claim 1, each of said magazines having two upwardly and downwardly open receiving shafts for the bags, said shafts being connected for joint displacement transversely of the conveyor elongation.

3. A combination as defined in claim 1, said means for delivering further comprising a drive for said magazines, including a rack at each of said magazines, and a pinion meshing with and common to said racks.

4. A combination as defined in claim 3, said drive further comprising a control cam for driving said pinion, and a cam follower for limited rotating movement.

* * * * *